US007799210B2

(12) United States Patent
Dysard et al.

(10) Patent No.: US 7,799,210 B2
(45) Date of Patent: Sep. 21, 2010

(54) PROCESS FOR REMOVING SULFUR FROM NAPHTHA

(75) Inventors: Jeffrey M. Dysard, Michigan City, IN (US); Gordon F. Stuntz, Baton Rouge, LA (US); Thomas R. Halbert, Baton Rouge, LA (US); Andrzej Malek, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 307 days.

(21) Appl. No.: 11/100,309

(22) Filed: Apr. 6, 2005

(65) Prior Publication Data

US 2005/0252831 A1 Nov. 17, 2005

Related U.S. Application Data

(60) Provisional application No. 60/571,136, filed on May 14, 2004.

(51) Int. Cl.
*C10G 67/02* (2006.01)

(52) U.S. Cl. ..... 208/212; 208/213

(58) Field of Classification Search ..... 208/46, 208/85, 88, 89, 106, 107, 108, 177, 189, 208/209, 210, 211, 212, 213, 217, 226, 243, 208/244, 246, 247, 248, 249, 250, 208 R, 208/208 M
See application file for complete search history.

(56) References Cited

U.S. PATENT DOCUMENTS

| | | | | |
|---|---|---|---|---|
| 4,300,999 | A | 11/1981 | Davies et al. | 208/212 |
| 4,318,802 | A | 3/1982 | Van Grinsven et al. | 208/245 |
| 4,442,078 | A | 4/1984 | Jalan et al. | 423/230 |
| 4,455,286 | A | 6/1984 | Young et al. | 423/230 |
| 4,592,829 | A * | 6/1986 | Eberly, Jr. | 208/89 |
| 5,266,188 | A | 11/1993 | Kukes et al. | 208/216 R |
| 5,271,835 | A | 12/1993 | Gorawara et al. | 208/228 |
| 5,518,607 | A | 5/1996 | Field et al. | 208/212 |
| 5,582,714 | A | 12/1996 | Forte | 208/237 |
| 5,685,890 | A | 11/1997 | Okada et al. | 48/214 |
| 5,843,300 | A | 12/1998 | Zinnen et al. | 208/250 |
| 5,928,497 | A | 7/1999 | Iaccino | 208/212 |
| 5,985,136 | A * | 11/1999 | Brignac et al. | 208/210 |
| 6,013,598 | A | 1/2000 | Lapinski et al. | 502/305 |
| 6,096,194 | A | 8/2000 | Tsybulevskiy et al. | 208/244 |
| 6,126,814 | A | 10/2000 | Lapinski et al. | 208/217 |
| 6,171,478 | B1 | 1/2001 | Cabrera et al. | 208/212 |
| 6,187,176 | B1 | 2/2001 | Hantzer et al. | 208/268 |
| 6,228,254 | B1 | 5/2001 | Jossens et al. | 208/212 |
| 6,352,640 | B1 * | 3/2002 | Cook et al. | 208/237 |
| 6,387,249 | B1 * | 5/2002 | Cook et al. | 208/213 |
| 6,409,913 | B1 | 6/2002 | Clark et al. | 208/213 |
| 6,488,840 | B1 | 12/2002 | Greaney et al. | 208/189 |
| 6,540,907 | B1 | 4/2003 | Towler et al. | 208/211 |
| 6,610,197 | B2 | 8/2003 | Stuntz et al. | 208/210 |
| 6,649,061 | B2 | 11/2003 | Minhas et al. | 210/640 |
| 6,683,024 | B1 * | 1/2004 | Khare et al. | 502/400 |
| 6,723,229 | B2 | 4/2004 | Hantzer et al. | 208/210 |
| 6,736,962 | B1 | 5/2004 | Cook et al. | 208/210 |
| 6,896,795 | B2 | 5/2005 | Didillon et al. | 208/57 |
| 6,930,074 | B2 * | 8/2005 | Khare et al. | 502/342 |
| 6,960,291 | B2 | 11/2005 | Greaney et al. | 208/203 |
| 2002/0009404 | A1 * | 1/2002 | Tsybulevskiy et al. | 423/244.04 |
| 2002/0098971 | A1 | 7/2002 | Robinson et al. | 502/34 |

FOREIGN PATENT DOCUMENTS

| | | |
|---|---|---|
| EP | 0902078 | 3/1999 |
| JP | 60173090 | 9/1985 |
| JP | 60238389 | 11/1985 |
| WO | WO01/79391 | 10/2001 |

OTHER PUBLICATIONS

Filho, Rul de Souza Barbosa; and Faraco, Roberto Jose;"Selection of the Desulphurisation System of Naphtha," Boletim Tecnico de Petrobras, Rio de Janeiro, V.36, N. 1-4, 39-44, Jan.-Dec. 1993. (Abstract Translation Only).

* cited by examiner

*Primary Examiner*—Glenn Caldarola
*Assistant Examiner*—Randy Boyer

(57) ABSTRACT

A three-step process of removing sulfur from naphtha feeds. The steps include a first hydrotreating step, a mercaptan removal agent and an adsorbent containing a reactive metal on an inorganic support. Step one removes at least 95 wt. % of the sulfur compounds while preserving at least 50 wt. % of the olefins. Treatment with the mercaptan removal agent lowers the sulfur content to 30 wppm total sulfur and final naphtha product contains leas than 10 wppm total sulfur.

14 Claims, 1 Drawing Sheet

Figure
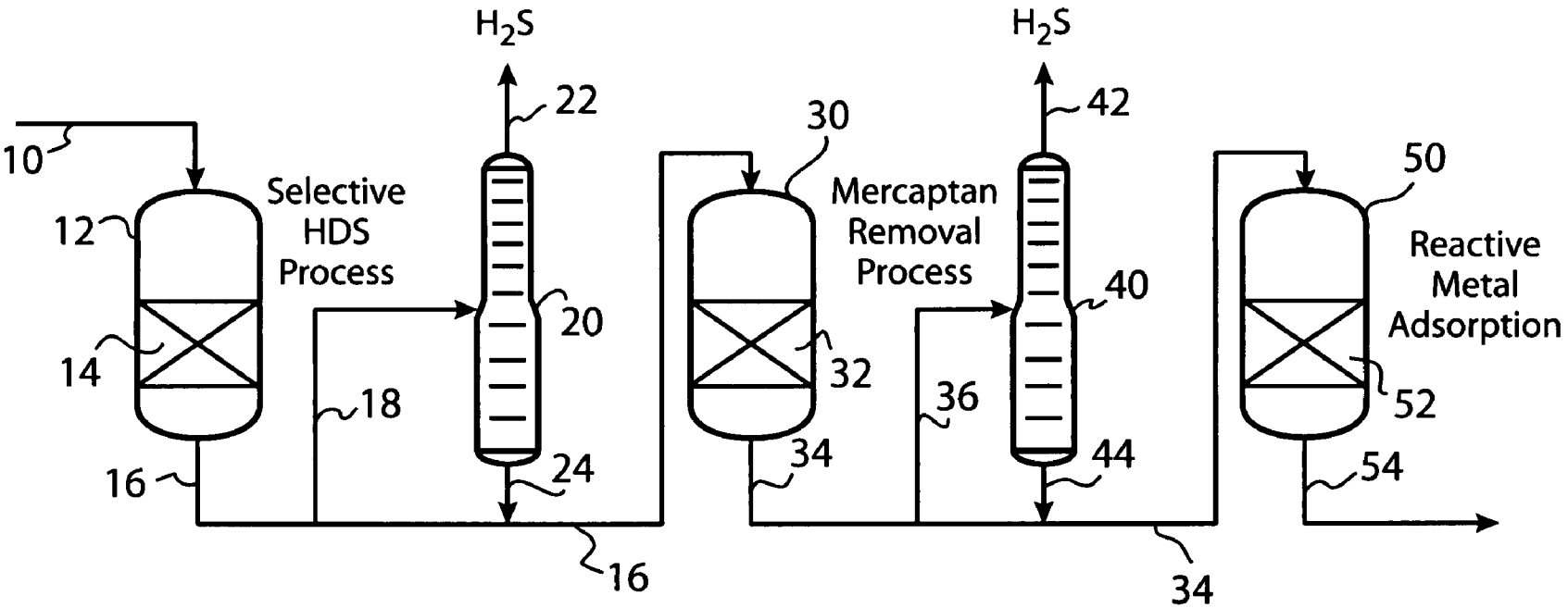

PROCESS FOR REMOVING SULFUR FROM NAPHTHA

CROSS-REFERENCE TO RELATED APPLICATION

This application claims benefit of U.S. Provisional Patent Application Ser. No. 60/571,136 filed May 14, 2004.

FIELD OF THE INVENTION

This invention relates to a process for removing sulfur from naphtha. More particularly, sulfur is removed from naphtha using a three-step process involving hydrotreating, selective removal of mercaptan sulfur and adsorption to remove remaining sulfur.

BACKGROUND OF THE INVENTION

Environmental regulations covering the sulfur content of fuels for internal combustion engines are becoming more stringent with regard to allowable sulfur in fuels. Motor gasoline sulfur content will need to meet a sulfur limit of 30 wppm between 2004-2006 with possible further reductions mandated in the future. One of the main components of motor gasoline is typically catalytically cracked naphtha, which contains substantial amounts of sulfur and olefins.

A common method for reducing the sulfur content of catalytically cracked naphtha feedstocks is by hydrotreating using catalysts that convert sulfur-containing species to hydrogen sulfide. The extent to which hydrotreating lowers the sulfur content of the hydrotreated product is typically dependent on the catalyst and hydrotreating conditions. For any given hydrotreating catalyst, the more severe hydrotreating conditions would be expected to reduce the sulfur content to the greater extent. However, such severe hydrotreating conditions normally result in a loss of molecules contributing to desirable octane properties either by cracking to non-fuel molecules or hydrogenation of olefins to molecules having lower octane rating. As the hydrotreating catalyst ages, it normally becomes necessary to adjust reaction conditions to maintain an acceptable catalyst activity. However, such adjustments result in further loss of desirable molecules contributing to high octane. This then results in increased production costs to produce high octane fuels because of the need to boost octane through added process steps such as isomerization, blending or addition of octane boosting additives.

One approach to addressing the problems associated with conventional hydrotreating is to use selective hydrodesulfurization, i.e., hydrodesulfurizing a feed with selective catalysts, selective process conditions, or both, to remove organosulfur while minimizing hydrogenation of olefins and octane reduction. For example, Exxon Mobil Corporation's SCANfining process selectively desulfurizes cat naphthas with little or no loss in octane number. U.S. Pat. Nos. 5,985,136; 6,013,598; and 6,126,814, all of which are incorporated by reference herein, disclose various aspects of SCANfining. Although selective hydrodesulfurization processes have been developed to avoid significant olefin saturation and loss of octane, $H_2S$ liberated in the process can react with retained olefins to form mercaptan sulfur by reversion. Such mercaptans are often referred to as "recombinant" or "reversion" mercaptans.

It is known that hydrotreating can be followed by additional steps such as adsorption or liquid extraction for mercaptan removal. An example of such post-hydrotreatment mercaptan removal is U.S. Pat. No. 6,228,254.

There is still a need to improve the sulfur removal process from feeds.

SUMMARY OF THE INVENTION

The process according to the invention is a three-step process involving catalytic hydrodesulfurization, mercaptan removal and reactive metal adsorption. The process for removing sulfur from a sulfur-containing naphtha feed comprises: (1) contacting the feed with a hydrotreating catalyst under hydrotreating conditions such that at least 50 wt. % of olefins in the feed are preserved and at least 95 wt. % of the sulfur compounds in the feed are converted to produce a hydrotreated effluent, (2) contacting the hydrotreated effluent with a mercaptan removal agent to produce a second effluent containing less than 30 wppm total sulfur, based on second effluent, and (3) contacting the second effluent with an adsorbent containing a reactive metal on an inorganic support to produce a naphtha product containing less than 10 wppm total sulfur, based on naphtha product.

The present process allows the catalysts to operate under conditions that produce a very low sulfur product while maintaining octane.

BRIEF DESCRIPTION OF THE DRAWING

The FIGURE is a schematic showing the sulfur removal process.

DETAILED DESCRIPTION OF THE INVENTION

The feedstock used as feeds in the present process are naphthas including petroleum naphthas, steam cracked naphthas, FCC naphthas, coker naphthas and mixtures thereof. FCC naphtha includes light, intermediate and heavy cat naphtha. Naphthas generally have final boiling points below 232° C. (450° F.), have olefin contents of up to 60 wt. % olefins, and may have high levels of sulfur compounds up to 4000 wppm or higher, based on naphtha. Typical olefin and sulfur contents range from 5 to 40 wt. % and 100 to 3000 wppm, respectively. The olefins include open chain and cyclic olefins, dienes, and cyclic hydrocarbons with olefin side chains. Sulfur compounds include mercaptans, disulfides and heterocyclic sulfur compounds such as thiophenes, tetrahydrothiophenes and benzothiophenes. Naphthas also typically contain nitrogen compounds in the range from 5 to 500 wppm.

Hydrodesulfurization (HDS) of naphtha feeds is accomplished by hydrotreating under conditions that will preserve at least about 50 wt. % of the olefins present in the feed while at the same time achieving at least about 95 wt. % conversion of sulfur compounds. Of the sulfur compounds remaining in the hydrotreated feed, >75 wt. % is often present as mercaptan sulfur. Although mercaptans in the feed along with other sulfur-containing species such as sulfides, disulfides, cyclic sulfur compounds such as thiophenes and aromatics containing sulfur may be converted to hydrogen sulfide, hydrogen sulfide may subsequently react with olefins to form mercaptans. These mercaptans are known as reversion mercaptans, and are generally of higher molecular weight ($C_4$+) than the mercaptans originally found in the feed. Such selective hydrotreating includes contacting the naphtha feed with hydrogen in the presence of a hydrotreating catalyst under selective hydrotreating conditions. Sulfur concentrations may be determined by standard analytical methods such as x-ray fluorescence, pyrolysis/UV fluorescence and potentiometry (ASTM 3227).

Hydrotreating catalysts are generally those with minimal hydrocracking activity (<10 wt. % conversion to lower boiling components) and include Groups 6, 9 and 10 metals and mixtures thereof (Groups are based on the IUPAC format with Groups from 1 to 18). Especially preferred are Ni, Co, Mo, W and mixtures thereof. The metals are supported on a low-acidity metal oxide support. Examples of such metal oxide supports include alumina, silica and silica-alumina, titania, calcium oxide, strontium oxide, barium oxide, magnesium oxide, carbon, zirconia, diatomaceous earth, lanthanide oxides including cerium oxide, lanthanum oxide, neodynium oxide, yttrium oxide and praesodynium oxide, oxides of chromium, thorium, uranium, niobium and tantalum, tin oxide, zinc oxide, and aluminum phosphate. A preferred support is alumina. Preferred catalysts are Ni/Mo and Co/Mo on an alumina support. The amount of metal calculated as metal oxides, either individually or as mixtures ranges from about 0.5 to 35 wt. %, based on catalyst. In the case of mixtures, the Group 9-10 metals are preferably present in amounts of 0.5 to 5 wt. % and the Group 6 metals in amounts of from 2 to 30 wt. %. The hydrotreating catalysts may also be bulk metal catalysts wherein the amount of metal is 30 wt. % or greater, based on catalyst.

A preferred catalyst that exhibits high hydrodesulfurization activity while preserving at least 50 wt. % of the feed olefin content is a Mo/Co catalyst having the following properties, including (a) a $MoO_3$ concentration of about 1 to 10 wt. %, preferably about 2 to 8 wt. %, and more preferably about 4 to 6 wt. %, based on the total weight of the catalyst; (b) a CoO concentration of about 0.1 to 5 wt. %, preferably about 0.5 to 4 wt. %, and more preferably about 1 to 3 wt. %, also based on the total weight of the catalyst; and (c) a Co/Mo atomic ratio of about 0.1 to about 1.0, preferably from about 0.20 to about 0.80, more preferably from about 0.25 to about 0.72. Other properties of the preferred catalyst include: (d) a median pore diameter of about 60 to about 200 Å, preferably from about 75 Å. to about 175 Å, and more preferably from about 80 Å to about 150 Å; (e) a $MoO_3$ surface concentration of about $0.5\times10^{-4}$ to about $3\times10^{-4}$ g. $MoO_3/m^2$, preferably about $0.75\times10^{-4}$ to about $2.5\times10^{-4}$, more preferably from about $1\times10^{-4}$ to about $2\times10^{-4}$; and (f) an average particle size diameter of less than 2.0 mm, preferably less than about 1.6 mm, more preferably less than about 1.4 mm, and most preferably as small as practical for a commercial hydrodesulfurization process unit. Such catalysts are further described in U.S. Pat. No. 6,013,598 which is incorporated herein in its entirety.

Hydrodesulfurization conditions for the naphtha feedstocks include: temperatures from about 200° C. to about 425° C., preferably from about 260° C. to about 355° C.; pressures from about 525 to 5617 kPa (60 to 800 psig), preferably from about 1480 to 3549 kPa (200 to 500 psig); liquid hourly space velocities of about 0.5 $hr^{-1}$ to about 15 $hr^{-1}$, preferably from about 0.5 $hr^{-1}$ to about 10 $hr^{-1}$, more preferably from about 1 $hr^{-1}$ to about 5 $hr^{-1}$, and hydrogen feed rates of about 178 to 1068 $m^3/m^3$ (1000 to 6000 scf/b), preferably from about 178 to 534 $m^3/m^3$ (1000 to 3000 scf/b). Hydrogen purity may be from about 20 to 100 vol. %, preferably from about 65 to 100 vol. %.

The second step involves removing at least 75% of the mercaptan in the hydrotreated effluent from step one while preserving at least 75% of the remaining olefins in the hydrotreated effluent from step one to produce a second effluent having at total sulfur content of less than 30 wppm. The methods for meeting the second step conditions include at least one of a second hydrotreating step, mercaptan adsorption, mercaptan extraction, mercaptan removal by at least one of depressurization and thermal or catalytic treatment, or membrane separation.

In the case of a second hydrotreatment step, it is preferred that hydrotreated effluent from step one be stripped of hydrogen sulfide and ammonia prior to the second hydrotreatment step. The second step hydrotreating catalysts may be the same as for the first step hydrotreating. The hydrotreating conditions may also be the same ranges as for the first step hydrotreating conditions. If desired, the temperature and space velocity may be increased over the hydrotreating temperature and space velocity used for the first step hydrotreating. The conditions and catalysts of the second step hydrotreating are directed to favoring hydrodesulfurization of mercaptans over olefin saturation thus preserving octane to the extent possible.

Mercaptan adsorption is a non-hydrotreating means of removing mercaptans from feeds and products. It is preferred that hydrotreated effluent from step one be stripped of hydrogen sulfide and ammonia prior to the adsorption step. In one embodiment, mercaptans are adsorbed by means of chemisorption using metals or metal oxides. Metals may be from Groups 7-12 of the IUPAC periodic table and include at least one of Ni, Co, Cu, Pt, Zn, Mn, and Cd which metals or metal oxides may be supported on a porous carrier such as clay, carbon or metal oxides such as alumina. The metals or metal oxides adsorb sulfur by chemisorption, typically by formation of metal sulfides. Another form of adsorbent is based on adsorbents that physically adsorb mercaptans. This class of adsorbents typically utilizes molecular sieves as the adsorbent. Examples of this type of adsorbent include crystalline metal silicates and zeolites of the faujasite family such as zeolites X and Y, zeolite A and mordenite. Adsorbents may include metal exchanged forms with metals from Groups 1-12. U.S. Pat. No. 5,843,300 is incorporated herein in its entirety and is an example of the use of metal exchanged zeolites. Adsorption can also be accomplished by ion-exchange resins. In the adsorption technique, the naphtha effluent from the HDS reactor is contacted with adsorbent usually in the form of a fixed bed. In the case of mercaptans that are removed by physical techniques, it may be possible to regenerate the adsorbent by heating, reduced pressure, stripping or some combination thereof to desorb the mercaptans. Those adsorbents that function by chemisorption are typically replaced when spent as they are non-regenerable or very difficult to regenerate. Contacting with adsorbent is normally at ambient temperatures for physical adsorbents whereas chemisorption operates at elevated temperatures of 70° C. up to 500° C.

Mercaptan extraction to retain 75 wt. % of olefins while removing at least 75 wt. % of mercaptan may be accomplished using caustic extraction. Caustic extraction using the MEROX™ and EXTRACTIVE MEROX™ processes are available from UOP Products, Des Plains, Ill. In these processes, oxidation of the caustic phase is accomplished using an iron group-based catalyst. Phase transfer catalysts may be added to the extraction. It is also known to selectively extract naphtha fractions for mercaptans using caustic extraction containing cobalt phthalocyanine as disclosed in U.S. Published Patent Application 2003/0052044, which in incorporated herein in its entirety. Other selective extractants include glycols, glycol ethers and mixtures thereof. Extraction techniques may be combined with other separation techniques such as fractionation into light and heavy naphtha fractions and extracting the light fraction to remove mercaptans. Contacting between hydrotreated naphtha and extractant may be liquid-liquid or vapor-liquid using conventional equipment such as packed towers, bubble trays, stirred vessels, fiber contacting, rotating disc contacting and the like. Contacting temperatures may range from ambient to mildly elevated temperature such as 100° C. depending on the extractant system employed. Pressures can range from 0 to 200 psig.

Mercaptan removal from naphtha by depressurizing the hot naphtha from the HDS reactor, thermally treating the hot naphtha or both can be used for selective mercaptan removal. In this method, hot naphtha from the HDS reactor is rapidly depressurized which converts mercaptan to hydrogen sulfide. The pressure is reduced to no more than 50% that of the HDS reactor, preferably no more than 25%, pressure being measured at the exit of the HDS reactor. The total pressure at depressurization is about 300 psig or less, preferably no more that 200 psig and the depressurization time is sufficient for the effluent from the HDS reactor to reach thermodynamic equilibrium at the final pressure. Depressurization temperature is no less that that of the initial temperature of the HDS reactor. Depressurization can occur in a depressurization reactor. In the alternative, hot naphtha from the HDS reactor is heated to a temperature greater than the original HDS temperature thereby converting mercaptan to $H_2S$. In the thermal treatment method, the total pressure of the hot naphtha from the HDS reactor is substantially constant. The temperature is at least that of the HDS reactor, preferably from greater than 0 to 100° C. greater than the temperature of the HDS reactor. Heating times may vary from 0.5 seconds to 10 minutes. Additional details relating to the depressurization and thermal treatment may be found in U.S. Pat. No. 6,387,249 B1, which is incorporated herein in its entirety.

Membrane separation can also be used for separating sulfur compounds from hydrotreated naphtha. Membrane separation involves the selective permeation of sulfur compounds through a membrane. Membranes may be ionic or non-ionic. Preferred ionic membranes include Nafion®—type membranes. Naflon membranes are acidic membranes and hydrophilic in nature and are preferably used in the presence of a transport agent. Transport agents such as alcohols and ethers are sorbed by the membrane thereby increasing flux through the membrane. Their selectivity for sulfur compounds may be increased by reaction with organic bases. Preferred non-ionic membrane materials are hydrophilic materials including cellulose triacetate and polyvinylpyrrolidone. Non-ionic membranes typically do not require a transport agent. In the membrane separation process, the hydrotreated effluent from step one is passed through a membrane supported in a membrane module to form a sulfur rich permeate and a sulfur lean retentate. The techniques of membrane separation are known and reference is made to U.S. Published Patent Application 2002/0111524 A1, which is incorporated herein in its entirety.

The mercaptan removal step allows the subsequent step relating to adsorbent containing active metal on a support to primarily remove any thiophenes that may remain in the treated naphtha. The effluent from the mercaptan removal step may be stripped to remove $H_2S$ prior to the reactive metal adsorption step. In the sulfur removal step by active metal adsorbent, the adsorbents are typically not regenerable or regenerable with difficulty.

The reactive metal adsorbent may includes metals or metal oxides which metals are in a reduced oxidation state. Reactive metals may include metals from Groups 1, 2 and 5-12. Examples include Na, Li, K, Ba, Ca, V, Cr, Mn, Fe, Co, Ni, Cu, Zn, Pt and Pd. The reactive metal sorbents react with the sulfur species such as thiophenes to form metal sulfides. This may take place in the substantial absence of hydrogen or hydrogen may be present. The reactive metals are supported on a support such as a metal oxide, clay or carbon. Such supports include alumina, silica, silica-alumina, magnesia, titania, zirconia, hafnia, carbon or clays such as attapulgite and sepiolite.

The reactive metal adsorbent may be prepared by incipient wetness impregnation of a support by a metal salt solution. The metal salt solution may also contain an organic acid, amine or alcohol as an aid in metal dispersion. Preferred dispersants are aminoalcohols such as alkanol amines. The impregnated support is then dried, calcined and reduced to form a reactive metal adsorbent.

The contacting of the product of step (2) of the present process, i.e., the product resulting from treatment with a mercaptan removal agent, with the reactive metal adsorbent may take place in the same location or may take place in a remote location. By remote location is meant that the contacting with reactive metal adsorbent may take place in a location other than the location in which steps (1) and (2) occur, e.g., a terminal or on-board a motor vehicle.

The naphtha product after treatment with reactive metal adsorbent is very low in sulfur and contains less than 10 wppm sulfur, based on naphtha, preferably less than 5 wppm, most preferably less than 1.

The process is further exemplified by the FIGURE. In the FIGURE, high sulfur naphtha is conducted through line 10 to selective hydrodesulfurization reactor 12. The naphtha then contacts hydrotreating catalyst 14 to produce a hydrodesulfurized effluent and the effluent is conducted from reactor 12 through line 16. Hydrodesulfurized effluent may be optionally conducted to stripping unit 20 through line 18 and stripped gases removed through line 22. Stripped effluent is returned to line 16. Alternatively, hydrodesulfurized effluent may be directly conducted to mercaptan removal apparatus 30 containing mercaptan removal bed 32. Hydrodesulfurized effluent is passed through bed 32 to produce a second effluent containing less than about 30 wppm sulfur. This second effluent is passed to line 34 where it may optionally be conducted through line 36 to a second stripping unit and stripped gases removed through line 42. Stripped second effluent is returned to line 34 through line 44. Alternatively, second effluent may be passed directly through line 34 to reactor 50 and contacted with adsorbent containing supported reactive metal in bed 52. The product that is obtained after passing through bed 52 is a low sulfur naphtha product containing less than about 10 wppm sulfur. This low sulfur product is removed from reactor 50 through line 54.

The following non-limiting example serves to illustrate the invention.

EXAMPLE

A reactive metal adsorbent was prepared by impregnating a silica support with nickel hexahydrate containing a triethanolamine dispersant. The sample was dried by heating in air at 60° C. and then ramping the temperature to 350° C. to convert the metal to the oxide form.

The adsorbent in oxide form was then reduced to Ni metal form by placing the sample in a flow-through reaction unit and in contact with flowing hydrogen. The temperature was ramped to 350° C. After holding at 350° C. for 2 hours, the adsorbent was cooled to 200° C. A gasoline-range hydrocarbon blend containing 80 ppmw sulfur as thiophene was then introduced to the reaction unit containing the Ni adsorbent at 210 psig (1549 kPa), 200° C. and 1 liquid hourly space velocity. This feed is similar to the product obtained from step (2) of the present process. The product resulting from feed treatment with the Ni adsorbent was then cooled and analyzed for sulfur. The product was found to contain less than 1 wppm sulfur.

The invention claimed is:

1. A process for removing sulfur from a sulfur-containing naphtha feed comprising: (1) contacting the feed with a hydrotreating catalyst under hydrotreating conditions such that at least 50 wt. % of olefins in the feed are preserved and at least 95 wt. % of the sulfur compounds in the feed are converted to produce a hydrotreated effluent, (2) contacting the hydrotreated effluent with a mercaptan removal agent to produce a second effluent containing less than 30 wppm total sulfur, based on second effluent, the mercaptan removal being at least one of mercaptan extraction, mercaptan removal by depressurization, mercaptan removal by thermal treatment, physical adsorption, or membrane separation, and (3) contacting the second effluent with an adsorbent to produce a naphtha product containing less than 10 wppm total sulfur, based on naphtha product, the adsorbent consisting essentially of at least one reactive metal in a metallic state on an inorganic support, wherein the at least one reactive metal consists of one or more elements selected from Groups 1, 2, and 5-12 and wherein the inorganic support consists of one or more support materials selected from alumina, silica, silica-alumina, magnesia, titania, zirconia, hafnia, carbon, and a clay.

2. The process of claim 1 wherein the hydrotreating catalyst contains at least one of Ni, Co, Mo or W on an alumina support.

3. The process of claim 2 wherein the hydrotreating catalyst is a Mo/Co catalyst including a $MoO_3$ concentration of 1 to 10 wt % based on weight of catalyst, a CoO concentration of 0.1 to 5 wt %, and a Co/Mo atomic ratio of about 0.1 to 1.0.

4. The process of claim 1 wherein the hydrotreating conditions in step (1) include temperatures of from 200 to 425° C., pressures of from 525 to 5617 kPa, liquid hourly space velocities of from 0.1 to 15 $hr^{-1}$, and hydrogen feed rates of from 178 to 1068 $m^3/m^3$.

5. The process of claim 1 wherein the second hydrotreating step includes second hydrotreating conditions.

6. The process of claim 5 wherein the second hydrotreating conditions are the hydrotreating conditions of step (1) except that the temperatures are at least 10° C. higher than those of step (1) and the liquid hourly space velocities are 1.5 times greater than those of step (1).

7. The process of claim 1 wherein the mercaptan extraction is by caustic extraction.

8. The process of claim 1 wherein the mercaptan removal is by at least one of depressurization or thermal treatment.

9. The process of claim 1 wherein at least 75 wt. % of olefins are preserved in step (2).

10. The process of claim 1 wherein the adsorbent contains active metal functions in the absence of hydrogen.

11. The process of claim 1 wherein the naphtha product contains less than 5 wppm sulfur.

12. The process of claim 11 wherein the naphtha product contains less than 1 wppm sulfur.

13. The process of claim 1 wherein step (3) takes place in a location remote from steps (1) and (2).

14. The process of claim 1 wherein the reactive metal is nickel.

* * * * *